United States Patent [19]

Galli

[11] 4,081,010

[45] Mar. 28, 1978

[54] PENCIL SHARPENER FOR NON-CIRCULAR SECTION PENCILS

[75] Inventor: Luigi Galli, Milan, Italy

[73] Assignee: Fabrica Italiana Lapis ed Affini (Fila) SpA, Italy

[21] Appl. No.: 659,364

[22] Filed: Feb. 19, 1976

[30] Foreign Application Priority Data

Feb. 19, 1975 Italy ..... 20427 A/75

[51] Int. Cl.[2] ..... B43L 23/00

[52] U.S. Cl. ..... 145/3.1; 145/3.3; 145/3.61

[58] Field of Search ..... 145/3.1, 3.3, 3.31, 145/3.5, 3.6, 3.61

[56] References Cited

U.S. PATENT DOCUMENTS

| | | | |
|---|---|---|---|
| 2,525,854 | 10/1950 | Becker | 145/3.31 |
| 2,857,884 | 10/1958 | Itano | 145/3.31 |

*Primary Examiner*—James L. Jones, Jr.
*Assistant Examiner*—J. T. Zatarga
*Attorney, Agent, or Firm*—Robert E. Burns; Emmanuel J. Lobato; Bruce L. Adams

[57] ABSTRACT

A pencil sharpener for non-circular section pencils comprising a first tubular element for receiving the pencil without permitting the sliding or rotation of the latter relatively to the former. The sharpener is fitted with cams near the top end thereof, a second tubular element with a reduced tubular extension at one end thereof forms a stop for the first element, with a communicating hole between the second element and the extension shaped as a cam, carrying the cutting blade of the sharpener. The second element has at the other end a closing disk fitted with an abutment on the inner side and a cam-like profile hole similar to the communication hole between the second element and the extension. The holes are designed to receive a third pair of cams at the end of the first element. The second element has at least one fixed striker and at least one elastic striker interacting respectively with the first pair and second pair of cams of the first element resulting when the first element is rotated around the second one in a composed rotating motion of the pencil around its own axis along a closed-ring path so that the side surface of the pencil in contact with the cutting blade will constantly remain in contact therewith.

9 Claims, 7 Drawing Figures

PENCIL SHARPENER FOR NON-CIRCULAR SECTION PENCILS

BACKGROUND OF THE INVENTION

The present process relates in general to pencil sharpeners and in particular to a pencil sharpener for non-circular cross section pencils.

DESCRIPTION OF THE PRIOR ART

The problems relating to the sharpening of pencils of a non-circular section, in particular of elliptical section, is today resolved by using a common blade or a blade fitted to a suitable holding support. The drawbacks inherent in such a manual operation are well known, among others the excessive consumption of the pencil, the irregular point formed, the ability required by the person supposed to sharpen the pencil, the time necessary to obtain a good point. These drawbacks become still more pronounced when using pencils which are very soft with the resulting point easily broken by the irregular stresses it is subjected to the action of the blade.

SUMMARY OF THE INVENTION

The principal object of the present invention relating to a pencil-sharpener for non-circular cross section pencils is to eliminate the above-mentioned drawbacks by permitting an efficient, regular and fast pencil sharpening operation without the undesirable breaking of the points.

This object is attained by the pencil-sharpener for non-circular pencils of the present invention substantially consisting of a first tubular element having an inner section allowing the insertion of the pencil to be sharpened without the possibility of rotating the same relatively to the said first element, and having on the outer side surface at least one pair of first and second cams, each pair being arranged near the head end of the said first tubular element; of a second tubular element provided at one end with a tubular extension. The second tubular element is designed to contain the first tubular element with the tubular extension of the second element forming an arresting crown for the first tubular element, on the bottom of the second tubular element, with a communicating hole between the second tubular element and the said tubular extension thereof. The hole has a cam-like conformation and presents on the side surface thereof an inclined plane respective to the longitudinal axis of the second tubular element, carrying the cutting blade of the pencil sharpener. The second element carries at the other end a closing disk with a fixed striker on the inside side and a cam-shaped hole similar to the communication hole between the second element and the respective extension. The holes are suitably designed to receive the profiles of a third pair of cams near the end of the first tubular element. The second tubular element have at the inside at least one fixed and at least one elastic striker which can be engaged by the first and respectively by the second cams on the first tubular elements. The first, second and third cams are so stepped that, following the rotation of the first tubular element inside the second tubular element. The pencil will carry out rotational movement around its own axis and at the same time displace the axis along a closed-ring path, so that the side surface of the pencil in contact with the cutting blade will continuously maintain its contact with the cutting blade.

BRIEF DESCRIPTION OF THE DRAWINGS

The present invention will be still better understood on hand of the description of a preferred embodiment thereof, without being limited thereto, and of the accompanying drawings, in which.

DESCRIPTION OF THE PREFERRED EMBODIMENT

Figure 1:
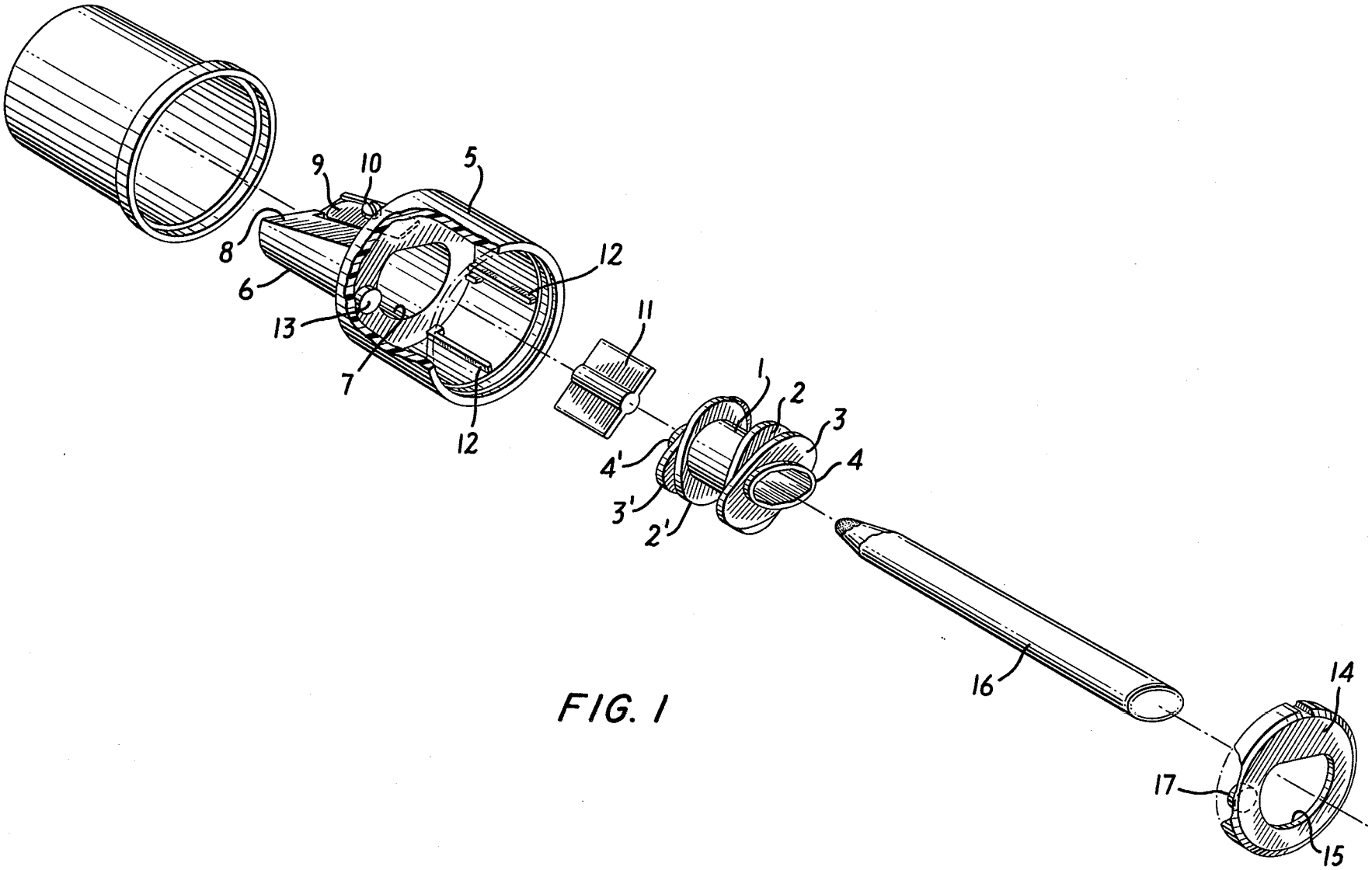
FIG. 1 is a general perspective exploded view of the pencil sharpener according to the present invention.

The pencil sharpener for non-circular cross section pencils according to the present invention, comprises a first tubular element 1 of an inner cross section suitably designed to receive inserted therein a pencil 16 to be sharpened without the possibility of the one rotating relatively to the other one. The pencil 16 is oval in cross section. In the pencil sharpener shown in the drawings, the inner cross section is elliptical, made for easier manufacture. However, it is obvious that the form may be varied according to the cross section of the pencil to be sharpened. The first tubular element 1 has on external side surfaces three pairs of cams, respectively 2—2', 3—3' near the heads and 4—4' near the ends. The cams are stepped one pair against the other ones, are symmetric ally seated with respect to a center plane crossing the tubular element 1. The tubular element 1 is constructed that it can be contained within an outer second tubular element 5, provided at one end with a tubular extension 6 of smaller cross section with a cam shaped communication hole 7. A removable cover can be placed over the extension as shown. The extension 6 has the shape of a common pencil sharpener and has on the side surface a flat 8 inclined with respect to the longitudinal axis of the tubular element 5, cutting blade 9 is removably fixed thereto with a screw 10. The cutting blade 9 can be adjustably inclined relative to the axis according to the pencil point it is desired to obtain. Experience has proved that an inclination of 15° represents the optimum value for satisfying at the same time different requirements. The outer second tubular element 5 is in addition provided with an elastic striker formed of a laminar spring 11 of known shape, made of a plastic material, positioned by means of grooves 12, on the inside side surface of the tubular element 5, and has a fixed striker 13. The assembled two tubular elements 1 and 5 are locked by means of a disk 14 provided with a hole 15 having a cam-shaped outline similar to the hole 7. An inner fixed striker 17 is positioned similarly to the striker 13.

Figure 3:
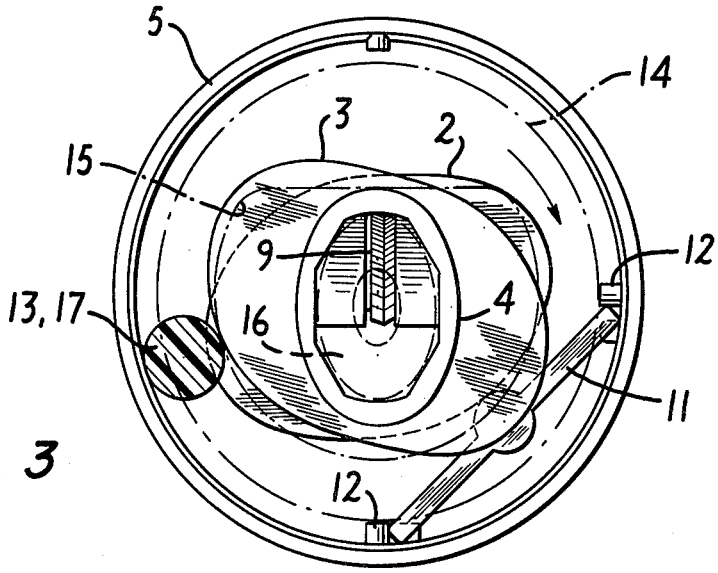
FIGS. 3, 4, 5 and 6 are section views of with the parts shown in four different rotation positions stepped by 45°.
Figure 4:
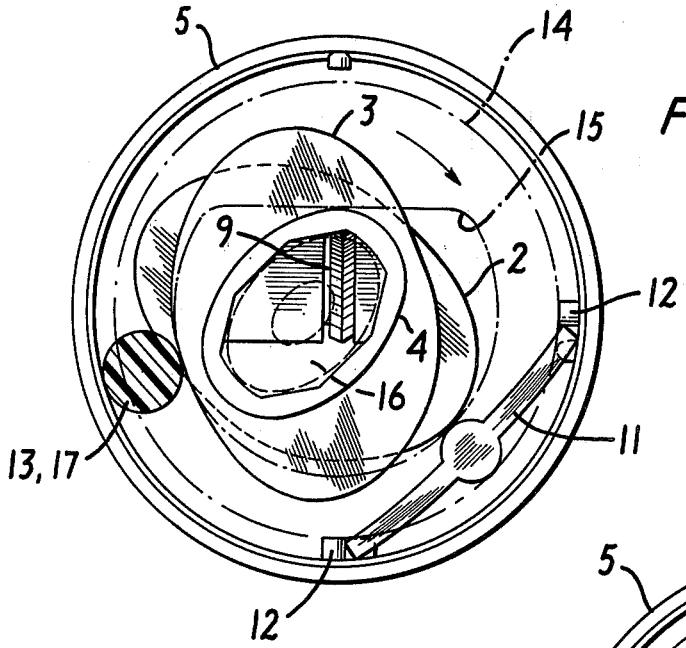
Figure 5:
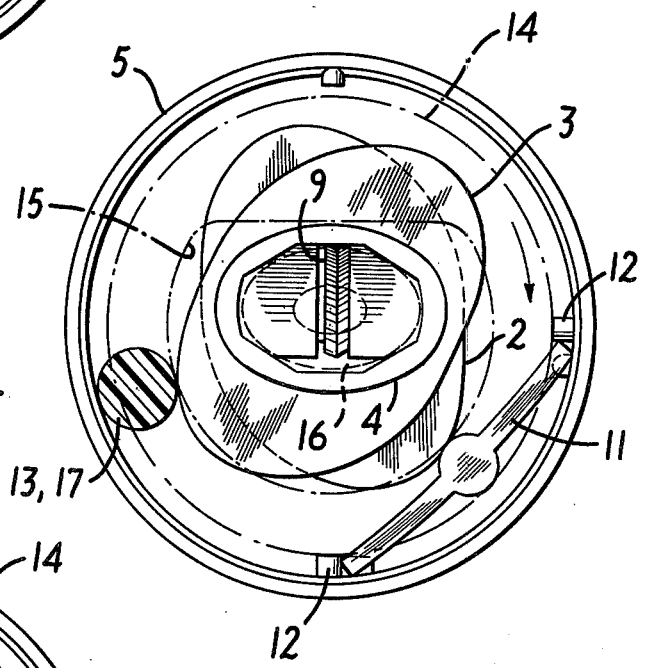
Figure 6:
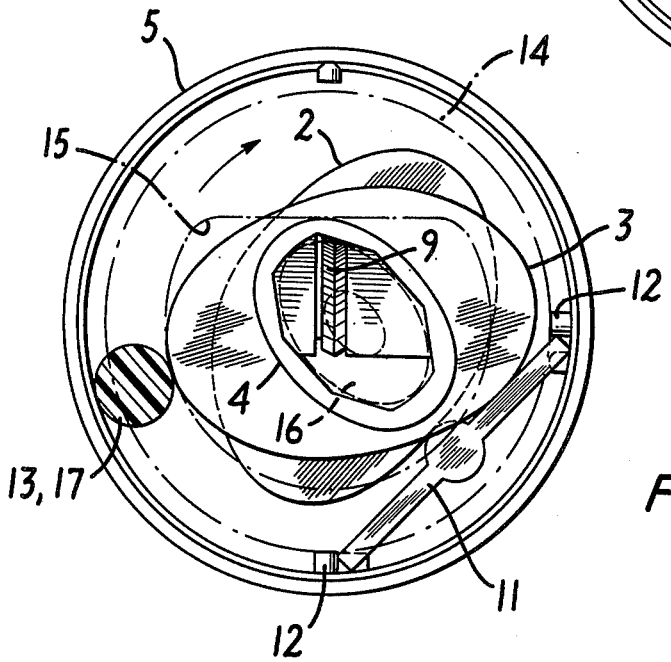

The operation of the pencil sharpener of the present invention is shown in detail in FIGS. 3, 4, 5 and 6 illustrating four different positions of the pencil rotated through 45° each, seen from the front of the pencil. The technical problem to be resolved to obtain a uniformly shaped point on the oval pencil consists in maintaining the point in continuous contact with the cutting blade, while the pencil is rotating around its own axis and the axis is displacing itself along a closed oval path. This problem has been resolved by provision of the three pairs of cams arranged on the outer surface of the first tubular element 1 which permit the pencil to vary the fulcrum of the ellipse it follows according to its shape acting on fixed or elastic strikers preset as required. In particular the profiles of the pair of cams 2—2', continuously influenced by the elastic striker 11, always maintain the pressure necessary for the cutting operation, while the profiles of the pairs of cams 3—3' and 4—4' by means of the fixed strikers 17 and 13 and the conjugated profiles of the holes 15 and 7 make the pencil follow the desired closed path. The proposed pencil sharpener has the further advantage of allowing the pencils of non-circular cross section to be sharpened according to practical, accurate, fast and trustworthy characteristics.

The pencil 16 is inserted axially into the sharpener through the opening 15 of the end disk 15 into the inner tubular member 1 and extends through the hole 7 communicating with the extension 6. The pencil extends into the extension which as stated above is similar to a conventional sharpener and has an axial slit into which the blade cutting edge extends in conventional manner to sharpen the pencil 16 as it is rotated.

It can be seen that the bore of the inner tubular member is oval in cross section and receives the oval pencil therein so that when rotated by rotating the pencil there is no relative movement between it and the pencil therein. As the pencil is rotated manually about its axis the cams 2, 3 and 2', 3' which are offset angularly about the longitudinal axis as shown bear on the resilient members 11, 13, 17.

Figure 2A:
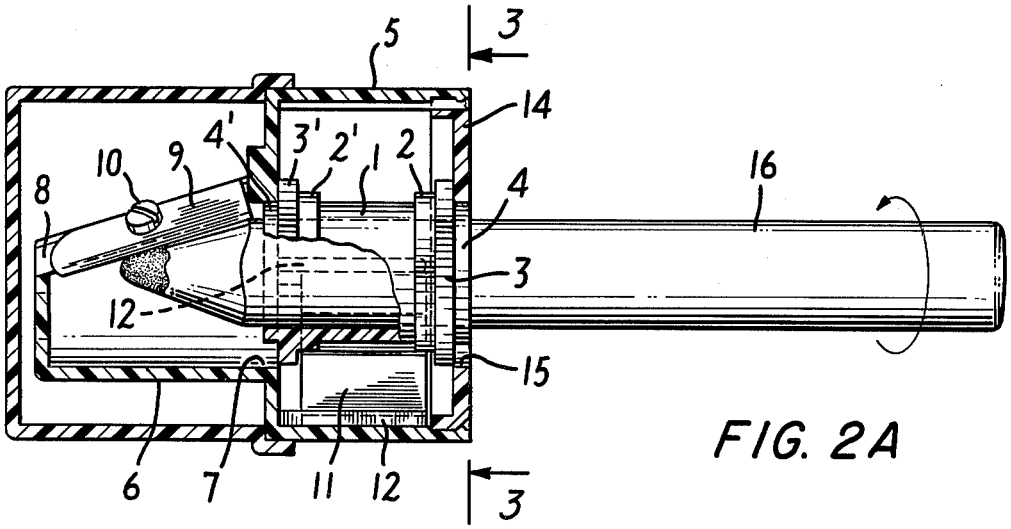
FIGS. 2A and 2B are side section views of the same pencil sharpener illustrating two different positions of the elements as a pencil is sharpened according to the invention.
Figure 2B:
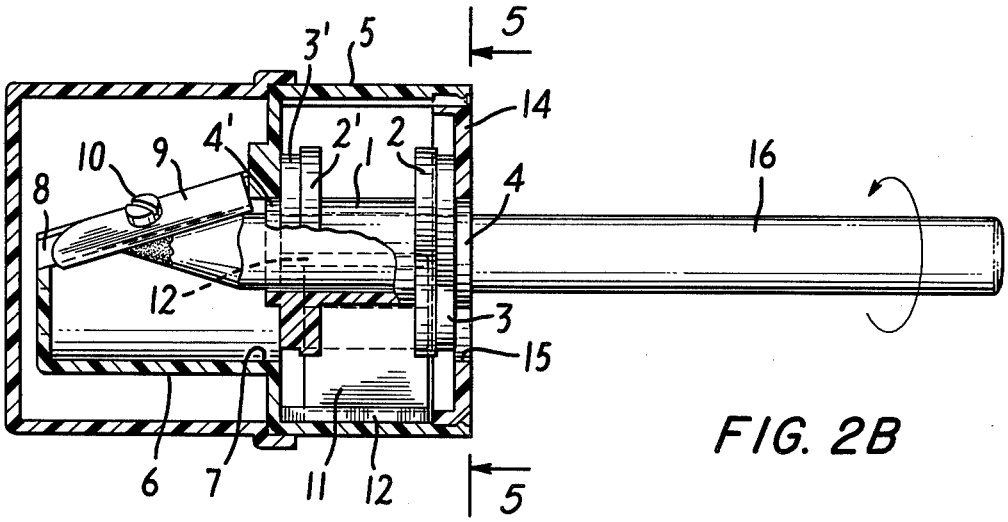

The cams are configured so that the axis of the inner tubular members 1 and the axis of the pencil jointly describe a common elliptical or oval path. This can be readily seen from the various positions of the inner tubular member and cams thereon in the FIGS. 2A – 6 inclusive which show the elements at different angular positions as the pencil is rotated in a direction for engaging the sharpening blade. This oval path in conjunction with the fact that the blade is an angle relative to the axis of the sharpener results in the pencil being sharpened so that it has a tapered tip which is oval in cross section. The tip edge is substantially flat.

It is evident that modifications and variations may be made to the proposed pencil sharpener as described herein without leaving the desired field of application and protection.

We claim:

1. A sharpener for a pencil non-circular in cross section comprising, a housing, a rotatable element in said housing having means for defining a bore for receiving therein a pencil of non-circular cross section extending axially therein for rotation with said pencil therein, said bore being configured in cross section to maintain said pencil from rotation relative to said rotatable element upon rotation of said pencil, means for defining an extension on said housing defining a space for receiving in use a leading portion of said pencil extending axially therein, a blade mounted on said extension having a cutting edge inclined relative to a longitudinal axis of said housing, means on said rotatable element for rotatably guiding said rotatable element for rotation with said pencil therein eccentrically relative to said longitudinal axis and for engaging said pencil with said cutting edge for thereby cutting a tapered, non-circular tip on said pencil upon rotation thereof for sharpening.

2. A sharpener for a pencil non-circular in cross section according to claim 1, in which the last-mentioned means comprises means for rotatably guiding said rotatable element for rotation along a path of rotation eccentrically relative to the longitudinal axis of the housing symmetrically with respect thereto.

3. A sharpener for a pencil non-circular in cross section according to claim 2, in which said path is oval and is about said longitudinal axis of said housing.

4. A sharpener for a pencil non-circular in cross section according to claim 1, in which the last-mentioned means comprises a plurality of cams slidable in said housing, and biasing means biasing said rotatable element in a direction for maintaining said pencil in contact with said cutting edge.

5. A sharpener for a pencil non-circular in cross section according to claim 4, in which said biasing means comprises spring means.

6. A method for sharpening a pencil having a non-circular cross section comprising providing both a pencil having a non-circular cross section and a sharpener having a fixed blade with a cutting edge at an angle relative to a longitudinal axis and a rotatable element for removably receiving a non-circular pencil axially therein rotatable eccentrically relative to said longitudinal axis, inserting a pencil non-circular in cross section in said rotatable element free of relative rotational movement between the element and said pencil, rotating said rotatable element and said pencil therein eccentrically relative to said longitudinal axis and in contact with said cutting edge thereby cutting a sharpened tip on said pencil which is non-circular about the longitudinal axis of the pencil.

7. A method for sharpening a pencil having a non-circular cross section according to claim 6, in which said rotation is along a path effective to cut said tip symmetrically with respect to said longitudinal axis of said pencil.

8. A method for sharpening a pencil having a non-circular cross section according to claim 7, in which said path and said tip are oval.

9. A method for sharpening a pencil according to claim 6, in which said pencil is a cosmetic pencil.

* * * * *